US005158846A

United States Patent [19]

Bujese

[11] Patent Number: 5,158,846

[45] Date of Patent: Oct. 27, 1992

[54] ELECTROSTATIC COLOR PRINTING SYSTEM UTILIZING AN IMAGE TRANSFER BELT

[75] Inventor: David P. Bujese, Southington, Conn.

[73] Assignee: Olin Corporation, Cheshire, Conn.

[21] Appl. No.: 605,065

[22] Filed: Oct. 29, 1990

[51] Int. Cl.[5] ..... G03G 15/14

[52] U.S. Cl. ..... 430/47; 430/44; 355/327

[58] Field of Search ..... 430/47, 44; 355/327, 355/77

[56] References Cited

U.S. PATENT DOCUMENTS

| | | | |
|---|---|---|---|
| 3,591,276 | 7/1971 | Byrne | 355/3 |
| 3,893,761 | 7/1975 | Buchan et al. | 355/3 R |
| 3,923,392 | 12/1975 | Buchan et al. | 355/3 R |
| 4,095,886 | 6/1978 | Koeleman et al. | 355/3 FU |
| 4,604,424 | 8/1986 | Cole et al. | 524/862 |
| 4,796,048 | 1/1989 | Bean | 355/3 TR |
| 4,990,969 | 2/1991 | Rapkin | 355/327 |

*Primary Examiner*—Marion E. McCamish
*Assistant Examiner*—S. Rosasco
*Attorney, Agent, or Firm*—Ralph D'Alessandro

[57] ABSTRACT

An improved color printing method and the apparatus for employing the method are provided for continuously superimposing a plurality of separate color toner images onto a common conductive intermediate transfer belt from a plurality of developing drums across a liquid filled gap to form a single full color image. The separate colors have masters mounted to the developing drums and the superimposed full color image is contact transferred with the aid of heat and pressure from the conductive intermediate transfer belt to the final receiving paper substrate after all of the liquid has been removed from the superimposed full color image.

14 Claims, 3 Drawing Sheets

ELECTROSTATIC COLOR PRINTING SYSTEM UTILIZING AN IMAGE TRANSFER BELT

BACKGROUND OF THE INVENTION

This invention relates generally to color printing and, more specifically, to a method and the apparatus for employing the method of continuously superimposing a plurality of color toner images onto a common intermediate transfer belt from a plurality of developing drums. The latent image is developed with liquid toner.

Prior electrostatic copiers or printers employing liquid toners transfer the toned image from a photoreceptor or a master directly to the receiving paper substrate. These devices require that the solvent or liquid in which the toner particles are suspended be transferred to the receiving paper substrate. This requires drying of the paper before it can be used and adds to the complexity of the devices.

Other copiers and printers employ an intermediate transfer belt or drum to transfer the toned image to paper by heat and pressure. These prior systems have required the receiving paper substrate to be registered to each of the plurality of colors, adding to the complexity of the apparatus.

A system employing a liquid toner has been developed to transfer a liquid developed image from a photoconductor to a copy sheet via an intermediate transfer surface from which the carrier liquid is roller squeezed or removed by infrared heating to be substantially free of carrier liquid prior to the final image transfer to the copy sheet. However, this does not remove all of the solvent from the copy sheet, since solvent is still present in the image areas. The intermediate transfer surface is formed from a material described as non-absorbing and resilient, but transfer from the photoconductor to the intermediate transfer surface is effected by contact pressure and the intermediate transfer surface is deformed by contact with the toner particles in the image areas to achieve the transfer from the photoconductor covered drum to the intermediate transfer surface. This negatively affects the quality of the transferred image by distorting the image because of the contact or pressure involved in the transfer step.

A number of the prior approaches utilized in electrophotographic copiers have employed dry powder toner that was contact or pressure tranferred from the photoconductive surface to an intermediate transfer surface and then to the final receiving surface. These approaches were also susceptible to image distortion during the transfer from the photoconductor because of the pressure or contact involved in the transfer step. They also transferred less than 100% of the toner particles from the intermediate transfer surface to the final receiving surface. None of these approaches attempted to use a liquid toner to improve the resolution of the transferred image.

One such system utilized an electrophotographic copier with a rotatable photoconductive drum that transferred a dry toner developed image to a silicone elastomer transfer belt that was part of a transfer and fusing system. This was employed in combination with a radiant fuser and paper transport system to provide a high speed copier.

Another related system employed an intermediate transfer drum which received the dry toner developed image from a rotatable drum whose surface was coated with a photoconductor. The intermediate transfer drum utilized a support material, such as aluminum, and had its surface coated with a suitable conductive or non-conductive silicone rubber having low specific heat that was applied in a thin layer. These intermediate transfer surfaces were described as having smooth surfaces of low surface free energy and a hardness of from 3 to 70 durometers.

Compositions designed specifically for use as thermally conductive elastomers in a fuser roller for electrostatic copying machines were developed by the Dow Corning Corporation. The compositions were thermally conductive polyorganosiloxane elastomers that possessed high abrasion resistance, low durometer hardness and high heat conductivity.

Xerox Corporation developed an elastomeric intermediate transfer surface that was either formed into a belt or was formed on the surface of a drum as part of a process to transfer a dry powder xerographic image from a photoconductive surface to a final support surface, such as paper. Heat and pressure were utilized to transfer the developed powder image from the intermediate elastomeric transfer surface to the paper. However, this and all of the previously described approaches suffered from the aforementioned defects of image distortion and less than 100% toner particle transfer.

These problems are solved in the transfer method of the present invention and in the design of the electrostatic color printing system utilizing an intermediate image transfer belt where a plurality of toned color images corresponding to separate color separations are continuously individually superimposed onto a common intermediate transfer belt from a plurality of developing stations through a liquid-filled gap.

SUMMARY OF THE INVENTION

It is an object of the present invention to provide an improved method and apparatus employing that method to electrostatically transfer liquid toner developed images to an intermediate transfer surface and then to the final receiving paper substrate.

It is another object of the present invention to provide an improved method and apparatus for employing that method to continuously electrostatically transfer liquid color toned images across a liquid-filled gap to the intermediate transfer surface.

It is a feature of the present invention that the plurality of toned color separation images are superimposed in registry onto a common conductive elastomeric intermediate transfer surface through a liquid-filled gap.

It is another feature of the present invention that excess liquid, such as a non-polar insulating solvent that is a mixture of branched aliphatic hydrocarbons, is removed from around the superimposed transferred color images prior to fusing the full color image to the final receiving paper substrate.

It is still another feature of the present invention that the full color image having four or more colors is transferred to a conductive elastomeric fluorosilicone belt and then is heated and fused to the final receiving paper substrate in a contact transfer employing heat and pressure.

It is yet another feature of the present invention that the full color image is coated with the non-polar insulating solvent so that the colored toner particles remain in suspension until the solvent is removed subsequent to the transfer of all of the plurality of color toners and the fusing of the toner particles together.

It is an advantage of the present invention that the liquid suspended toner particles do not affect the electrical transfer field strength and no color toners are trapped.

It is another advantage of the present invention that the registration of the plurality of colors is simplified over prior systems.

It is still another advantage of the present invention that the non-polar insulating liquid solvent is not transferred to the final receiving paper substrate.

It is yet another feature of the present invention that the final receiving paper substrate path within the apparatus is very short and does not require the paper to be registered to every color employed.

It is still a further advantage of the present invention that the apparatus is low cost, compact in size, and simply designed to facilitate maintenance.

These and other objects, features and advantages are obtained by the color printing method and apparatus employing the method to continuously superimpose in registry a plurality of color toned images onto a common intermediate elastomeric transfer surface from a corresponding plurality of color developing stations via an electrostatic transfer across a liquid-filled gap, preheating the transferred full color image after removing the liquid from the transfer surface, and contact transferring the full color image by heat and pressure to the final receiving paper substrate.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
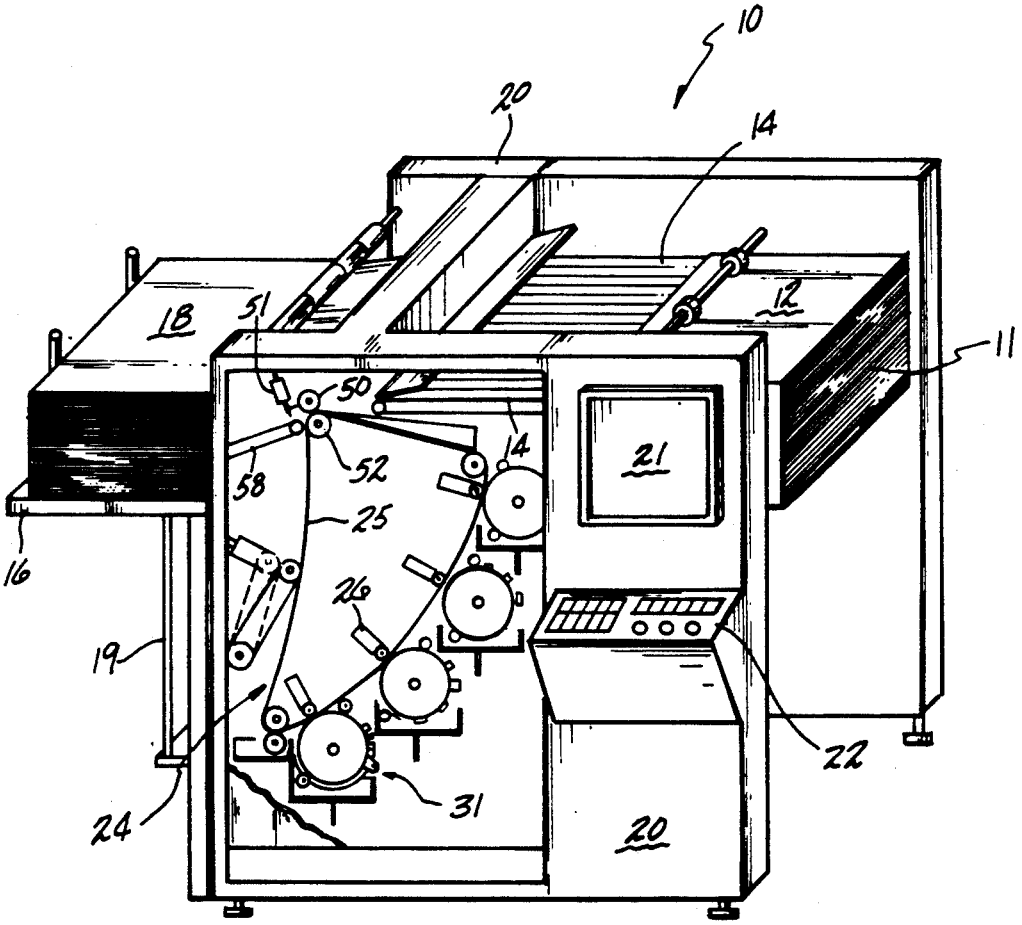
FIG. 1 is a front perspective view of a the color printing apparatus of the present invention with a portion of the front cover broken away to show the transfer mechanism.

FIG. 1 shows the color printer, indicated generally by the numeral 10, in front perspective view with a portion of the front housing broken away to reveal the transfer mechanism, which is indicated generally by the numeral 24. A housing 20 contains the functional components of the printer 20, which include a paper feed mechanism, indicated generally by the numeral 11, that supplies the final receiving paper substrate in the form of sheets of paper 12 from a feed stack. The paper 12 is fed into the printer 10 via a vacuum paper conveyor 14 that passes the individual sheets of paper 12 beneath the paper shield and feed guide 15 to the interior of the printer 10 where it is fed into the nip formed by the fusing roller 50 and the belt drive roller 52. Once the color image has been transferred to the paper 12 in a manner to be described in further detail hereafter, the full color toned printer paper 12 is conveyed out of the printer 10 by the printed paper vacuum transport 58. Transport 58 delivers the printed sheets to the vertically movable printed paper support tray 16 that is moved along the vertical support rails 19 (only one of which is shown) by an appropriate electrical drive motor (not shown) to collect the stack of printed paper sheets 18.

The front panel of housing 20 has monitor screen 21 for viewing data on printing variables such as charge voltage, bias voltage, dot size, color density and other diagnostic input utilized to monitor the operation of the printer 10. Control panel 22 is used to control and adjust these operating variables by the printer operator.

Figure 2:
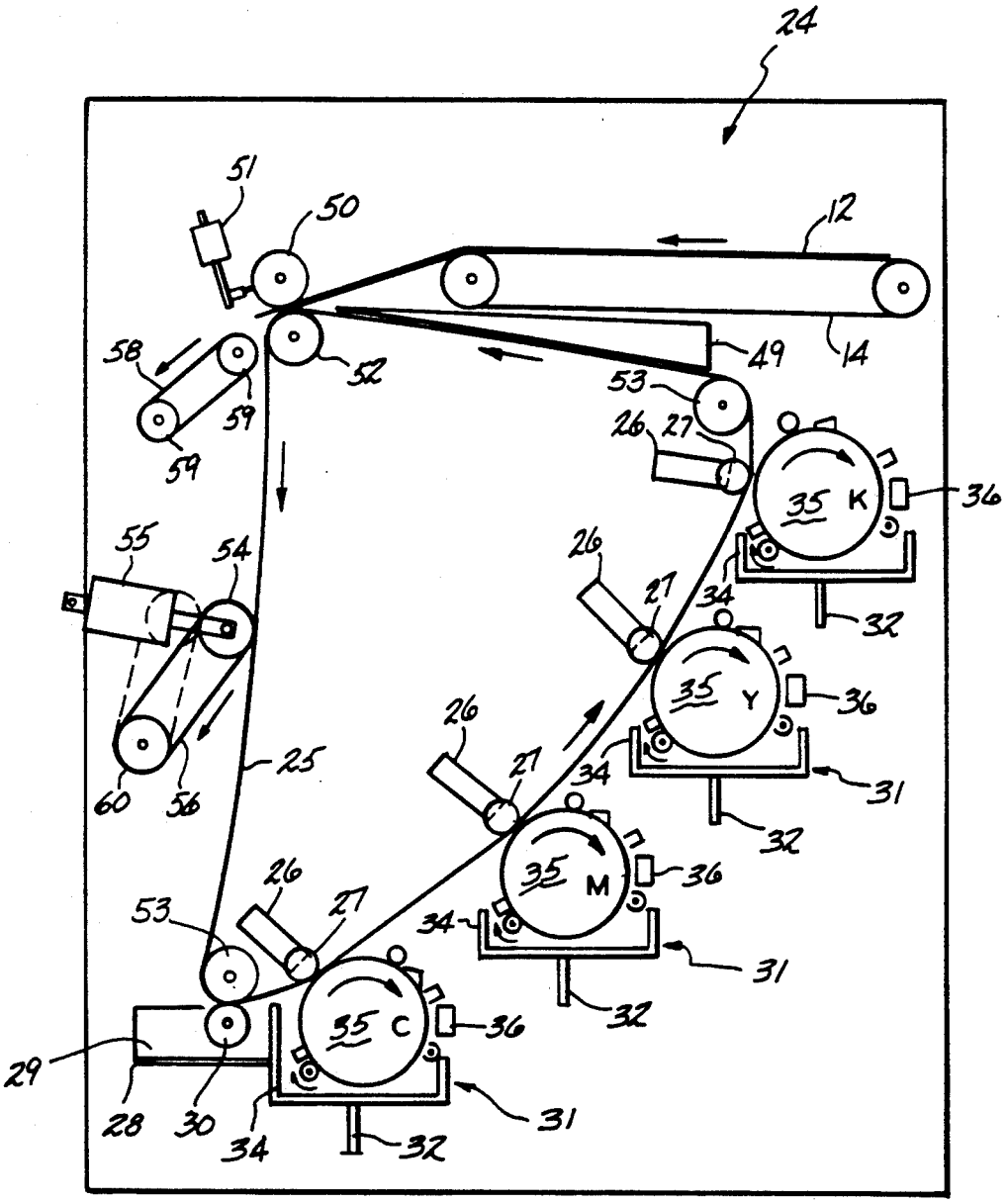
FIG. 2 is an enlarged side elevational view of the transfer mechanism showing the conductive fluorosilicone elastomeric intermediate transfer belt and the plurality of color toner developing stations or drums.

FIG. 2 shows in an enlarged side elevational view the transfer mechanism 24 that is seen in FIG. 1 behind the partially broken away front portion of the housing 20. An essential element of this transfer mechanism 24 is the conductive fluorosilicone intermediate transfer surface that is shown as a belt 25. Conductive fluorosilicone intermediate transfer belt 25 travels in a continuous path about guide rollers 53 and drive roller 52. Roller 52 is driven by the same motor (not shown) that rotates developing drums 35 on which are mounted either the permanent or reimageable master 38 (see FIG. 3 briefly), which can either be a photopolymer master or a reimageable photoconductor. Belt 25 is held in constant tension by regulated air cylinder 55 and belt tensioning roller 54 that contacts belt 25 along its width.

Conductive fluorosilicone intermediate transfer belt 25 is preferably a laminate that is comprised of a conductive material (not shown), preferably a conductive fluorosilicone that is adhesively fastened to a thinner conductive metal layer (also not shown), which is in turn appropriately fastened to an underlying supporting dielectric layer (not shown), such as heat stabilized polyester, polysulfone or polyethylene terpthalate.

The conductive fluorosilicone layer can range in thickness from about 0.5 to about 50 mils, preferably from about 2 to about 10 mils and more preferably about 5 mils thickness. The resistivity of the fluorosilicone layer should be from about $10^{-1}$ to about $10^{6}$ ohm-centimeters. The fluorosilicone material is made conductive by the addition of conductive carbon black particles, metal fibers or powder particles of sub-micron size to ensure good conductive linking throughout the material and for a good distribution during compounding. The preparation of this conductive fluorosilicone layer is described in greater detail in co-pending application U.S. Ser. No. 07/546,287 filed Jun. 29, 1990 and assigned to the assignee of the present invention and is specifically incorporated by reference in pertinent part. It is to be understood that the contact surface of this layer must be very smooth to ensure good toner release during transfer to the final receiving substrate, such as paper. Other potentially suitable materials such as metal fibers or powder particles include aluminum, silver, or graphite, as long as they are sub-micron and suitably sized not to affect the surface release characteristics of the conductive fluorosilicone layer.

The conductive metal layer (not shown) can range in thickness from 0.1 to about 1 mils and can include any appropriate metal or conductive material. It is through this conductive metal layer that the transfer voltage is applied to establish the electrostatic field to cause oppositely charged toner particles to be attracted through the liquid-filled gap to the surface of the conductive fluorosilicone layer via the conductive dispersion in the conductive fluorosilicone layer.

The dielectric layer (not shown) can range in size from about 3 to about 15 mils in thickness and must be heat stabilized so that the entire laminated conductive intermediate transfer surface or belt 25 is a material that is dimensionally stable under heat and tension.

The transfer mechanism 24 includes a wicking station 28, which applies a non-polar insulating solvent to the surface of the conductive intermediate transfer belt 25. The solvent is preferably comprised of a mixture of branched aliphatic hydrocarbons, such as those available under the tradename ISOPAR from Exxon Corporation. The solvent is held within tank 29 and has a wicking roller 30 rotatably mounted therein to apply the solvent to the belt 25. The roller 30 is partially immersed in the solvent within the tank 29 and applies an even coating to belt 25.

The plurality of color development modules, indicated generally by the numeral 31, are positioned adjacent the path of the conductive intermediate transfer belt 25. Each module is slidably mounted for movement and ease of access and maintenance on a slide 32 that pulls out generally horizontally from the front of the printer 10. Each module 31 includes a color toner tank 34 for the colors employed. These typically are cyan, magenta, yellow and black in four color images. The individual color toners within each module 31 are pumped from their respective toner tank 34 to the development electrode 39, seen best in FIG. 3.

Figure 3:
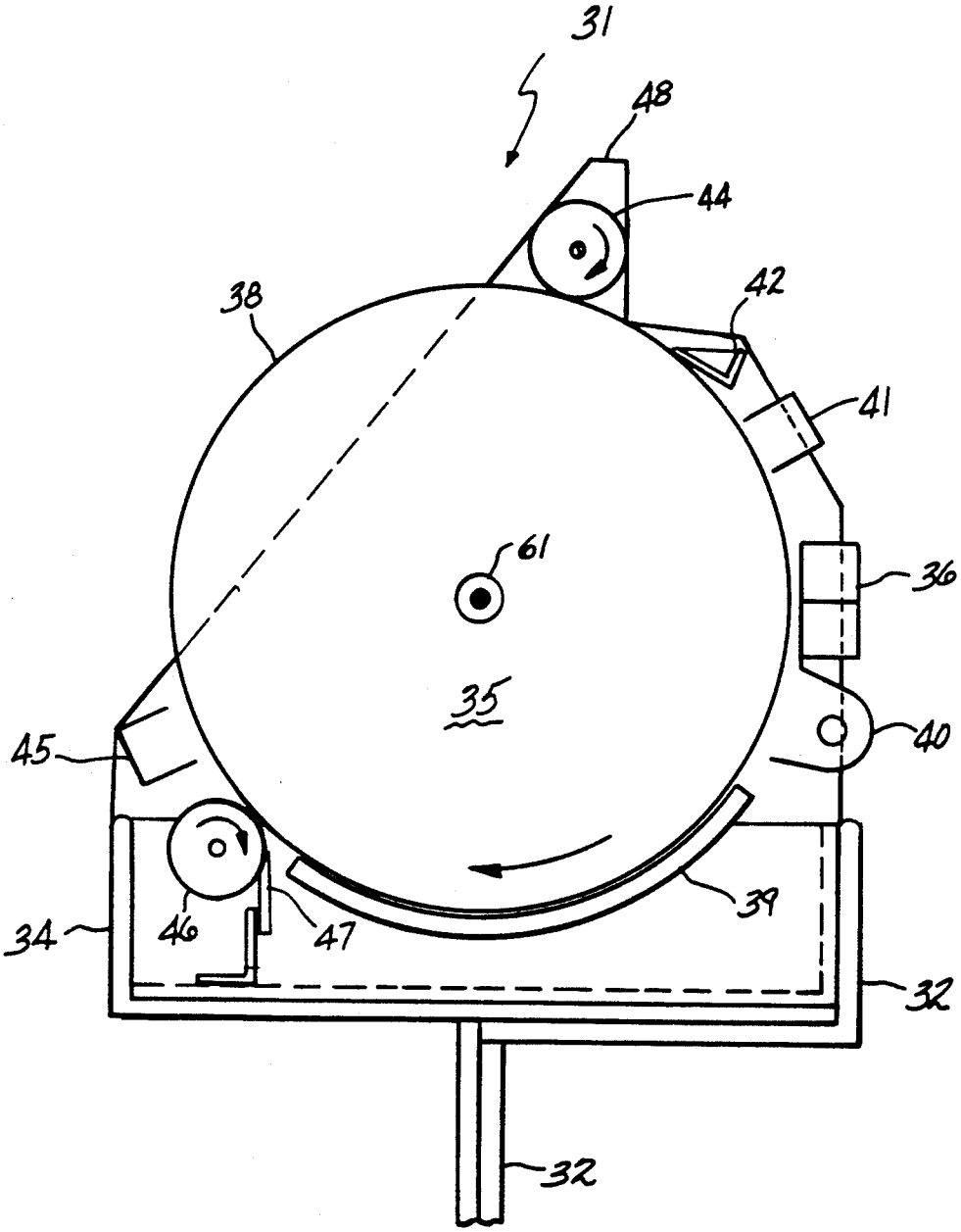
FIG. 3 is an enlarged side elevational view of one of the slidably removable color toner developing stations or drums.

As each of the developing drums 35 rotate around their shafts 61, which are mounted in development support plates 48 (only one of which is shown in FIG. 3), the detachable masters 38 mounted about the periphery of the drums are developed with the liquid toner by wetting. Arrayed in a counterclockwise progression within the module 31 around the periphery of each of the developing drums 35, after the development electrode 39, are a corona charging unit 36, a discharge corona unit 41, a wiper blade 42, and a cleaning roller 44. Above the development station toner tank 34 is a depressant corona unit 45. Rotatably mounted to the toner tank 34 is a reverse roller 46 which, in conjunction with the wiper blade 47 and the depressant corona unit 45, insures that any excess solvent surrounding the developed color toner image on the master 38 is removed. The color toner is suspended in a non-polar insulating solvent comprised of a mixture of branched aliphatic hydrocarbons, such as the aforementioned ISOPAR solvent.

Where a detachable photoreceptor, such as a photoconductor, is used instead of a photopolymer as the master 38, an exposure lamp 40 is employed and is positioned between the corona charging unit 36 and the development electrode 39. Where such a photoreceptor, for example an organic photoconductor, is employed an opaque toner mask will be used. In this instance, the background or non-imaged areas will be discharged by the exposure lamp 40.

Where a photopolymer master is used, such as those described in U.S. Pat. No. 4,879,184 issued Nov. 7, 1989 and assigned to the assignee of the present invention, the photopolymer is exposed prior to placement on the drum 35 within the printer 10 to form the latent image. The photopolymer is cross-linked only where it has been exposed. The charge from the corona charging unit 36 will remain on these cross-linked areas and will decay in the non-imaged areas which are not cross-linked and, therefore, less resistive.

The coating of the conductive intermediate transfer belt 25 and the master 38 with the non-polar insulating solvent and the liquid toner is essential to accomplish the electrostatic transfer of the color toner developed image on each of the drums 35 to the transfer belt 25 across a liquid-filled gap. This gap is maintained between each drum and the transfer belt 25 by the gap spacer adjusters 26, which are typically cam actuated, and the transfer rollers 27 attached thereto. The transfer rollers 27 can also be used to adjust the registration of the color image between each developing drum 25 and the conductive intermediate transfer drum 35 by adjusting the gap spacing adjusters 26. The transfer is effected by the application of an electric field via a high voltage charge continually applied to the metal conductive layer in the conductive intermediate transfer belt 25. This charge transfers the toned image on each master 38 through the approximately 0.001 to about 0.003 inch gap between the master 38 and the belt 25 in conjunction with the use of the transfer roller 27. This transfer across the liquid-filled gap is accomplished as described in greater detail in U.S. Pat. No. 4,879,184 issued Nov. 7, 1989 and assigned to the assignee of the present invention.

After each color image is transferred to the conductive intermediate transfer belt 25, any residual toner not removed from each master 38 is removed by cleaning roller 44 and wiper blade 42. Any charge remaining on the master 38 is erased by the high voltage AC charge from discharge corona unit 41 before the master is recharged and developed for a repeat transfer in another printing cycle.

After the four or more color images are transferred to the conductive intermediate transfer belt 25, excess toner is removed by either a reverse roller or an air knife (both of which are not shown).

The four or more color toner developed images, are superimposed on each succeeding color image on the transfer belt 25 to form a single full color image that remains surrounded and Partially suspended in the non-polar insulating solvent. This full color image is then preheated by the preheater unit 49 to partially fuse the toner particles and to remove the remaining non-polar insulating solvent from the toner particles. This also assists the fuser roller 50 in the final transfer to the final receiving paper substrate 12. Preheater unit 49 typically is an electrically resistant, radiant type of a heater. Preheater unit 49 has the heating elements (not shown) brought closer to the belt 25 as the belt 25 nears the nip, created by the fusing roller 50 and the belt drive roller 52, where the paper 12 is passed through to achieve the contact transfer of the image to the paper 12. This progressive closing of the distance between the heating elements and the belt 25 permits a ramping up or progressive heating of the belt 25 to progressively and gradually extract the non-polar insulating solvent from the toner image prior to the contact transfer to the paper 12. Too rapid an extraction of the solvent, typically the aforementioned ISOPAR, by evaporation from the image on the belt 25 can be detrimental to the image quality by causing cracking or other image distortion, especially where an air knife (not shown) is employed with the preheater unit 49.

The toner image is then transferred to the print paper 12 by heat and pressure in a contact transfer by being passed between the nip formed by the fuser roller 50 and the transfer belt 25 held in position by the drive roller 52. The pressure on the fuser roller 50 is maintained by the use of the fusing roller air cylinder 51 to insure the proper pressure is maintained at all times during the contact transfer. Fuser roller 50 is heated to help fuse the full color image to the paper 12, in conjunction with the pressure. In the event of a paper 12 misfeed, the fuser roller 50 can be moved out of engagement with the conductive intermediate transfer belt 25 by means of the air cylinder 51.

The paper 12 is conveyed into the nip between the fuser roller 50 and the transfer belt 25 by the vacuum paper conveyor 14 and its shield and paper guide 15. The paper 12 is transported in registration with each full color image on the conductive intermediate transfer belt 25. Each sheet of printed paper 18 is then conveyed by the printed paper vacuum transport conveyor 58 to the printed paper support tray 16 for stacking.

Should some of the full color toner image not be completely fused to the paper 12 and remain on the conductive intermediate transfer belt 25, it is removed by the belt cleaning web 56, best seen in FIG. 2. Web 56 is driven about idler rollers 54 and 60 by contact with the belt 25. The cleaning web 56 is maintained in contact with the conductive intermediate transfer belt 25 by means of the belt tensioning roller 54 and the air cylinder 55, which functions as an actuator to adjust the tension on the belt 25, as seen by the solid and phantom lines in FIGS. 2 and 3. Belt 25 is thus adjustably maintained in constant tension or may be adjusted to provide the slack to permit replacement of the conductive intermediate transfer belt.

The diameter of each of the developing drums 35, including the thickness of the masters 38, has been designed such that the length of the conductive intermediate transfer belt 25 is equal to the circumferences of the four developing drums 35 with the masters 38 attached. This permits the seam in the belt 25 to be positioned in relation to an indicator which is in direct relation to the non-imaged areas on the master drums and corresponds to the attachment device on the master drums 38. As the belt 25 travels every fourth revolution of a drum 38, the seam on the drums 38 will align with the seam on the belt 25 since the seams on the drum 35 are indexed to align with the seam on the belt 25. This permits a plurality of full color images, in this instance four, to be continuously superimposed on the surface or length of the belt 25 as it travels one complete revolution or traversal about its predetermined path to accomplish high speed color printing.

While the invention has been described above with references to specific embodiments thereof, it is apparent that many changes, modifications and variations in the materials, arrangements of parts and steps can be made without departing from the inventive concept disclosed herein. For example, in employing the masters 38 in the present invention, any suitably electrostatically imageable surface, including a photoreceptor, may be employed. This can include a photoconductor, such as a cadmium sulfide surface with a MYLAR polyester film or a polystyrene or a polyethylene overcoating, a selenium photoconductor drum, or suitable organic photoconductors such as carbazole and carbazole derivatives, polyvinyl carbazole and anthracene. If a master with a permanent latent image is desired, the surface can be a zinc oxide or organic photoconductor developed with a toner which is fused onto the master, or a dry film or liquid photoresist that is appropriately exposed.

Also, where a plurality of color toners are used to make a full color image, it is possible to use only three colors, not including black, to make the full color image and to create a black color from the three colors employed. This is appropriate where black is not utilized for highlighting.

Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety in pertinent part.

Having thus described the invention, what is claimed is:

1. A method of xeroprinting a color image onto a receiving substrate comprising the steps of:

(a) imaging a plurality of electrostatically imageable surfaces to create a plurality of masters each having a latent image corresponding to a separate color separation;

(b) developing the plurality of masters to create a plurality of liquid toned images;

(c) electrostatically transferring the plurality of liquid toned images from the developed masters to a common conductive intermediate transfer surface in a superimposed fashion to create a full color image;

(d) gradually and progressively removing the liquid from the superimposed transferred full color image by progressively heating by progressive closing of the distance between heating means positioned across a first gap and the conductive intermediate transfer surface to create a dry full color image; and (e) transferring the dry full color image by contact transfer from the conductive intermediate transfer surface to a final receiving surface.

2. The method according to claim 1 further comprising heating the conductive intermediate transfer surface with the full color image prior to the contact transfer to partially fuse the full color image.

3. The method according to claim 2 further comprising fusing the full color image to the final receiving surface with heat and pressure.

4. The method according to claim 3 further comprising continuously superimposing full color images on the conductive intermediate transfer surface.

5. The method according to claim 4 comprising using a continuous belt as the conductive intermediate transfer surface.

6. The method according to claim 5 comprising superimposing a plurality of full color images on the surface of the conductive intermediate continuous transfer belt every revolution of the belt as it travels about a predetermined path.

7. The method according to claim 6 comprising using paper as the final receiving surface.

8. The method according to claim 7 comprising using photoreceptors as the electrostatically imageable surfaces which are imaged to create the plurality of masters.

9. The method according to claim 7 comprising using photopolymers as the electrostatically imageable surfaces which are imaged to create the plurality of masters.

10. The method according to claim 7 further comprising controlling the amount of liquid between the plurality of developed masters and the conductive intermediate belt by means of controlling the size of the gap therebetween.

11. The method according to claim 10 further comprising having a separate developing station for each of the plurality of masters, each developing station having a reverse roller to help control the amount of liquid between each master and the conductive intermediate transfer belt.

12. The method according to claim 14 further comprising maintaining the plurality of superimposed toned images surrounded and at least partially suspended in liquid prior to removing the liquid to create the dry full color image.

13. The method according to claim 1 further comprising electrostatically transferring the plurality of liquid toned images across a liquid-filled gap from the plurality of developed masters to the common conductive intermediate transfer surface.

14. The method according to claim 1 further comprising forming a full color image including the color black by the use of three color separations not including the color black.

* * * * *

UNITED STATES PATENT AND TRADEMARK OFFICE

CERTIFICATE OF CORRECTION

PATENT NO. : 5,158,846
DATED : October 27, 1992
INVENTOR(S) : David P. Bujese

It is certified that error appears in the above-indentified patent and that said Letters Patent is hereby corrected as shown below:

On the Title page, item [73], Assignee: delete Olin Corporation, Cheshire, Conn. and insert -- Olin Hunt Specialty Products, Inc. Cheshire, Conn. --

Signed and Sealed this

Seventh Day of June, 1994

*Attest:*

Bruce Lehman

BRUCE LEHMAN

*Attesting Officer*

*Commissioner of Patents and Trademarks*